United States Patent [19]

Hoffman, Jr. et al.

[11] 4,394,086

[45] Jul. 19, 1983

[54] PARTICLE CONTAINMENT APPARATUS

[75] Inventors: James M. Hoffman, Jr., Walworth; Richard A. Lux, Webster, both of N.Y.

[73] Assignee: Xerox Corporation, Stamford, Conn.

[21] Appl. No.: 361,695

[22] Filed: Mar. 24, 1982

[51] Int. Cl.[3] ..... G03G 15/00

[52] U.S. Cl. ..... 355/3 R; 118/653; 355/3 DD; 355/15

[58] Field of Search ..... 355/3 R, 3 DD, 16, 15; 118/657, 658, 653, 654, 655; 430/120–123

[56] References Cited

U.S. PATENT DOCUMENTS

| | | | |
|---|---|---|---|
| 3,791,730 | 2/1974 | Sullivan | 355/3 DD |
| 3,809,012 | 5/1974 | Delvecchio | 118/637 |
| 3,872,826 | 3/1975 | Hanson | 355/3 DD |
| 3,900,002 | 8/1975 | Stange | 355/3 DD |
| 3,906,899 | 9/1975 | Harpavat | 118/637 |
| 4,127,083 | 11/1978 | Sesoko | 355/15 X |
| 4,155,329 | 5/1979 | Tsukamoto et al. | 118/658 |
| 4,168,901 | 9/1979 | Ito et al. | 355/3 DD |
| 4,304,192 | 12/1981 | Mayer | 118/653 |
| 4,337,724 | 7/1982 | Hosono et al. | 355/3 DD |

OTHER PUBLICATIONS

*Xerox Disclosure Journal*, "Toner Emission Control Concept", vol. 1, No. 4, Apr. 1976, pp. 73, 74.

*Xerox Disclosure Journal*, "Improved Emission Controller for Development Apparatus", vol. 2, No. 2, Mar. '77.

*Xerox Disclosure Journal*, "Method and Apparatus for Controlling Airborne Particle Emission", vol. 2, No. 2, Mar. '77, p. 35.

*Primary Examiner*—R. L. Moses

*Attorney, Agent, or Firm*—H. Fleischer; J. E. Beck; R. Zibelli

[57] ABSTRACT

An apparatus which controls air flowing into and out of a chamber in a housing to minimize the escape of particles therefrom.

10 Claims, 3 Drawing Figures

PARTICLE CONTAINMENT APPARATUS

This invention relates generally to an electrophotographic printing machine, and more particularly concerns an apparatus for preventing the escape of particles from a chamber in a housing storing a supply thereof.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface corresponding to the informational areas contained within the original document. After the electrostatic latent image is recorded on the photoconductive surface, the latent image is developed by bringing a developer material into contact therewith. This forms a powder image on the photoconductive surface which is subsequently transferred to a copy sheet. Finally, the powder image is heated to permanently affix it to the copy sheet in image configuration.

A suitable developer material usually comprises carrier granules with toner particles adhering triboelectrically thereto. This two-component mixture is stored in a developer housing and brought into contact with the electrostatic latent image recorded on the photoconductive surface. A portion of the toner particles are attracted from the carrier granules to the latent image. These toner particles adhere to the latent image so as to form the powder image on the photoconductive surface.

In addition to developing the latent image, residual particles are frequently cleaned from the photoconductive surface after transfer of the powder image to the copy sheet. A cleaning housing includes a chamber for storing the particles removed from the photoconductive surface.

For both the developer housing and the cleaning housing, it is highly desirable to prevent the airborne escape of particles stored in the chambers thereof. Any particles escaping from these chambers may contaminate the various processing stations within the printing machine possibly resulting in a degradation in copy quality. The problem of particle escape and machine contamination is a long standing one in electrophotographic printing. Various approaches have been devised for preventing the escape of particles from the developer housing. The following disclosures appear to be relevant:

| |
|---|
| U.S. Pat. No. 3,809,012<br>Patentee: Delvecchio<br>Issued: May 7, 1974 |
| U.S. Pat. No. 3,872,826<br>Patentee: Hanson<br>Issued: March 25, 1975 |
| U.S. Pat. No. 3,906,899<br>Patentee: Harpavat<br>Issued: September 23, 1975 |
| U.S. Pat. No. 4,304,192<br>Patentee: Mayer<br>Issued: December 8, 1981 |

The relevant portions of the foregoing disclosures may be briefly summarized as follows:

Delvecchio describes a developer housing having a side or end seal comprising a multiplicity of overlapping resilient deflector vanes projecting in the direction of movement of the photoconductive drum. The vanes deflect the carrier beads of the developer material inwardly away from the edges of the seal. This reduces developer material leakage under the seals. These seals are made from rubber and extend about the drum periphery in continuous engagement therewith.

Hanson discloses a developer housing including a top seal and end seals. The end seals are located on either side of the developer housing in the development zone. Each end seal is a strip of polyethylene foam secured to the developer housing and with free end in contact with the photoconductive drum. The top seal is a brush secured to the top of the developer housing with the free end portions of the brush contacting the photoconductive drum.

Harpavat describes a magnetic seal for a developer housing. The magnet attracts magnetic particles to form a seal between the developer housing and photoconductive drum.

Mayer discloses a thin strip of resilient material secured, in cantilever fashion, to the lip of the developer housing and extending to the developer roller. The strip provides a flexible closure which flexes to permit carrier granules to return to the reservoir while containing dust therein.

In accordance with one aspect of the features of the present invention, there is provided an apparatus for preventing particle contamination. The apparatus includes a housing defining a chamber for storing the particles therein. Means, operatively associated with the housing, define a surface area extending in a direction substantially parallel to and spaced from a moving member. The length of the surface area parallel to the moving member is much greater than the space therebetween to minimize air flow into and out of the chamber in the housing. In this way, the escape of particles from the chamber of the housing is prevented.

Pursuant to another aspect of the features of the present invention, there is provided an electrophotographic printing machine of the type having marking particles deposited on a photoconductive member in image configuration. The printing machine includes a housing defining a chamber storing at least the marking particles therein. Means, operatively associated with the housing, define a surface area extending in a direction substantially parallel to and spaced from the photoconductive member. The length of the surface area parallel to the photoconductive member is much greater than the space therebetween to minimize air flow into and out of the chamber in the housing. In this way, the escape of particles from the chamber of the housing is prevented.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
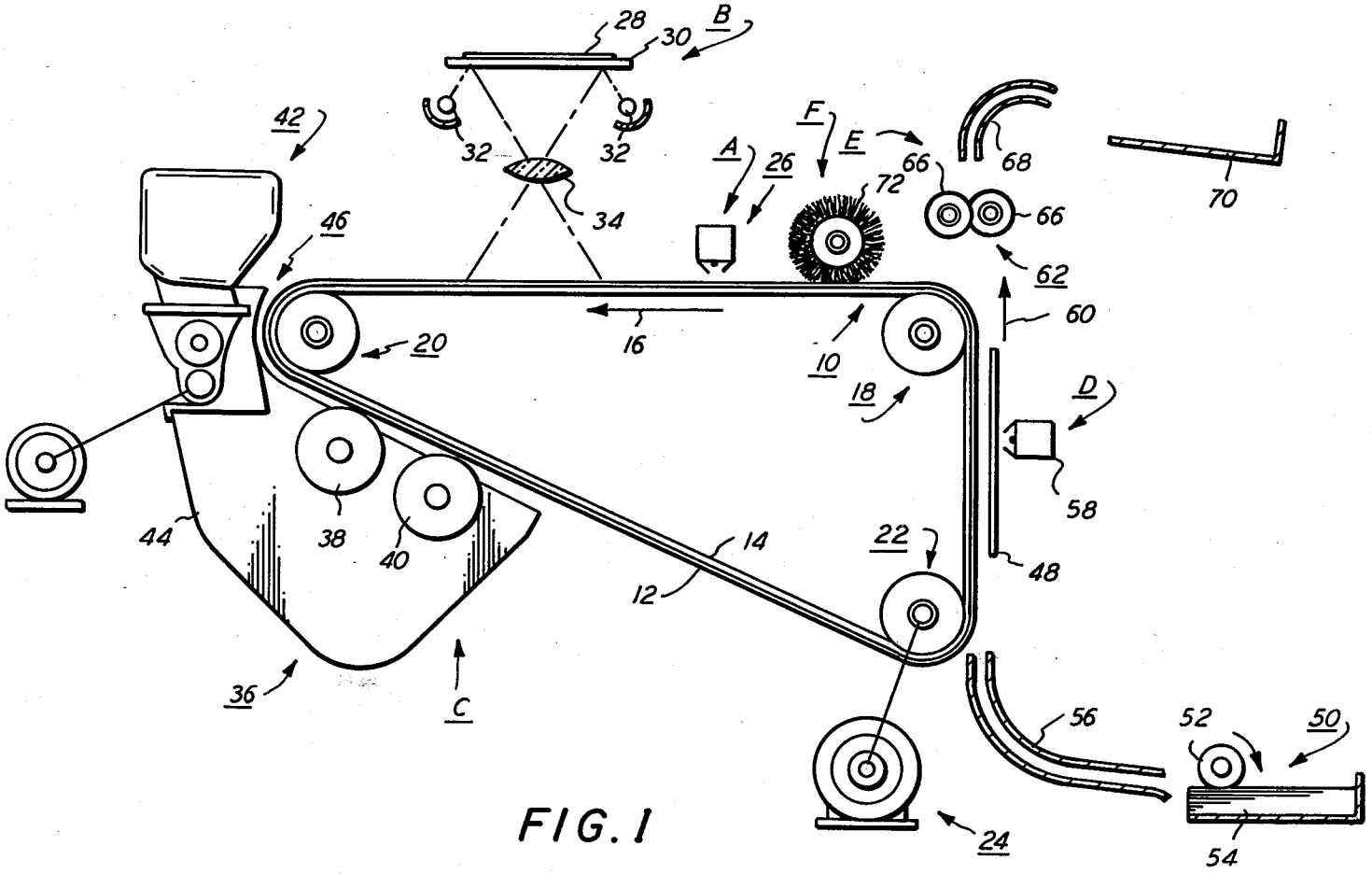
FIG. 1 is a schematic elevational view depicting an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the dirt barrier of the present invention therein. It will become apparent from the following discussion that this dirt barrier is equally well suited for use in a wide variety of machines and is not necessarily limited in its application to the particular embodiment shown herein.

Inasmuch as the art of electrophotographic printing is well known, the various processing stations employed in the FIG. 1 printing machine will be shown hereinafter schematically with their operation being described briefly with reference thereto.

Inasmuch as the development system of the electrophotographic printing machine stores a developer material comprising carrier granules and toner particles, it is necessary to insure that this material is not readily carried by any air currents from the developer housing to the other processing stations within the printing machine. Air flow out of the developer housing frequently transports toner particles resulting in contamination of the other processing stations within the printing machine. It should also be noted that when a magnetic brush cleaning system is employed, developer material is stored within the cleaning housing as well. Thus, the dirt barrier of the present invention, which will be described hereinafter with reference to an illustrative development system, may also be employed in such a cleaning system. Mass conservation within the enclosed volume of the housing requires that the air flow into the housing must be balanced with the air flow out of the housing. Hence, dirt control may be achieved by restricting either the air in flow or the air out flow, or both. The dirt barrier of the present invention restricts air flow through the gap between the housing and a moving surface, such as a photoconductive drum or belt.

Turning now to FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tension roller 20 and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a drive belt.

Drive roller 22 includes a pair of opposed, spaced edge guides. The edge guides defines a space therebetween which determines the desired path of movement of belt 10. Belt 10 is maintained in tension by a pair of springs (not shown) resiliently urging tension roller 20 against belt 10 with the desired spring force. Both stripping roller 18 and tension roller 20 are mounted to rotate freely.

With continued reference to FIG. 1, initially a portion of belt 10 passes through charging station A. At charging station A, a corona generating device indicated generally by the reference numeral 26, charges photoconductive surface 12 to a relatively high, substantially uniform potential.

Next, the charged portion of photoconductive surface 12 is advanced through exposure station B. At exposure station B, an original document 28 is positioned facedown upon a transparent platen 30. Lamps 32 flash light rays onto original document 28. The light rays reflected from original document 28 are transmitted though lens 34 forming a light image thereof. Lens 34 focuses the light image onto the charged portion of photoconductive surface 12 to selectively dissipate the charge thereon. This records an electrostatic latent image on photoconductive surface 12 corresponding to the informational areas contained within original document 28.

After the electrostatic latent image is recorded on photoconductive surface 12, belt 10 advances the latent image to development station C. At development station C, a magnetic brush development system, indicated generally by the reference numeral 36, advances the developer material into contact with the electrostatic latent image. Preferably, magnetic brush development system 36 includes two magnetic brush developer rollers 38 and 40. These rollers each advance the developer material into contact with the latent image. Each developer roller forms a brush comprising carrier granules and toner particles. The latent image attracts the toner particles from the carrier granules forming a toner powder image on photoconductive surface 12. As successive electrostatic latent images are developed, toner particles are depleted from the developer material. A toner particle dispenser indicated generally by the reference numeral 42, furnishes additional toner particles to housing 44 of development system 36. A dirt barrier, indicated generally by the reference numeral 46, prevents toner particles from escaping developer housing 44. The detailed structure of dirt barrier 46 will be described hereinafter with reference to FIGS. 2 and 3.

With continued reference to FIG. 1, after the electrostatic latent image is developed with toner particles, belt 10 advances the toner powder image to transfer station D. At transfer station D, a sheet of support material 48 is moved into contact with the toner powder image. The sheet of support material is advanced to transfer station D by a sheet feeding apparatus 50. Preferably, sheet feeding apparatus 50 includes a feed roll 52 contacting the uppermost sheet of stack 54. Feed roll 52 rotates so as to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet of support material at transfer station D.

Transfer station D includes a corona generating device 58 which sprays ions onto the backside of sheet 48. This attracts the toner powder image from the photoconductive surface 12 to sheet 48. After transfer, the sheet continues to move in the direction of arrow 60, onto a conveyor (not shown) which advances the sheet to fusing station E.

Fusing station E includes a fuser assembly, indicated generally by the reference numeral 62, which permanently affixes the transferred powder image to sheet 48. Preferably, fuser assembly 62 comprises a heated fuser roller 64 of a back-up roller 66. Sheet 48 passes between fuser roller 64 and back-up roller 66 with the toner powder image contacting fuser roller 64. In this manner, the toner powder image is permanently affixed to sheet 48. After fusing, chute 68 directs the advancing sheet 48 to catch tray 70 for subsequent removal from the printing machine by the operator.

After the sheet of support material is separated from photoconductive surface 12 of belt 10, the residual toner particles are removed therefrom. These toner particles are removed from photoconductive surface 12 at cleaning station F. Cleaning station F includes a rotatably mounted fibrous brush 72 in contact with photoconductive surface 12. The particles are cleaned from photoconductive surface 12 by the rotation of brush 72 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
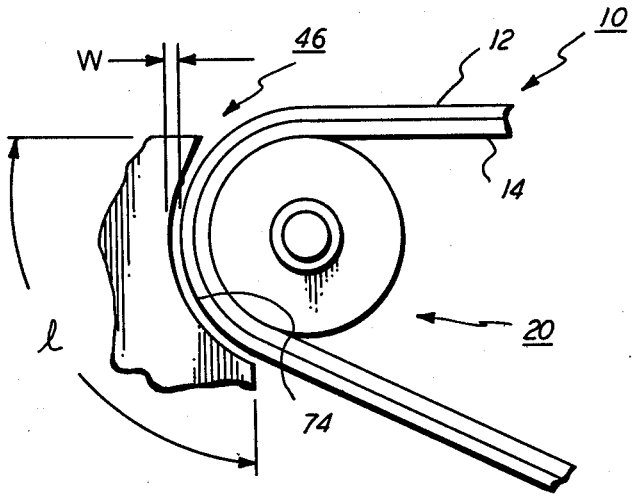
FIG. 2 is a fragmentary, elevational view showing the plate positioned adjacent the photoconductive belt to prevent the escape of particles from the chamber of the developer housing used in the FIG. 1 printing machine.

Referring now to FIG. 2, there is shown the detailed structure of dirt barrier 46 in greater detail. As depicted thereat, dirt barrier 46 includes a baffle plate 74 extending in a spaced, substantially parallel relationship to photoconductive surface 12 of belt 10. Baffle plate 74 extends substantially parallel to belt 10 a distance l. The space between surface area of baffle plate 74 and photoconductive surface 12 of belt 10 is maintained uniform and a distance $\omega$. The ratio of $l/\omega$ is such as to minimize air flow into and out of developer housing 44. In this way, toner particles are prevented from escaping therefrom. Preferably, the ratio $l/\omega$ ranges from about 10 to about 35. The preferred length, l is about 60 millimeters with the preferred space, $\omega$ between photoconductive surface 12 and the surface area of baffle plate 74 opposed therefrom, being about 2 millimeters. Preferably, plate 74 is made from sheet metal and secured to developer housing 44. Heretofore, the typical dirt barrier was a knife blade having a $l/\omega$ ratio of about 3 with the length of the blade extending parallel to the photoconductive surface being a distance of about 1.5 millimeters. The gap between the photoconductive surface and the blade was about 0.5 millimeters. Thus, for the knife blade to be effective in controlling air flow, it required tighter tolerances and closer spacing to the photoconductive surface. The knife blade is less desirable than the dirt barrier of the present invention because, at these close spacings, photoconductive surface damage is more likely to occur.

Figure 3:
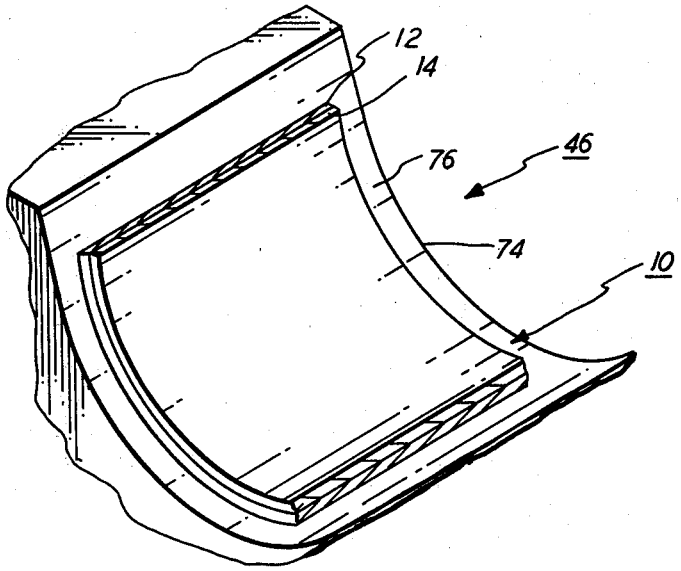
FIG. 3 is a fragmentary, perspective view depicting the relationship between the FIG. 2 plate and photoconductive belt.

Referring now to FIG. 3, there is shown a fragmentary perspective view of dirt barrier 46. As depicted thereat, surface area 76 of plate 74 extends in a direction substantially parallel to and spaced from photoconductive surface 12 (FIG. 2) of belt 10. Surface area 76 extends continuously across belt 10. Thus, the space between plate 76 and belt 10 is substantially uniform across the width of belt 10 as well as long the length thereof. In this way, it is clear that the $l/\omega$ ratio is adjusted such that the impedance to air flow is sufficiently great to minimize or substantially eliminate any air flow into and out of developer housing 44. Inasmuch as there is little air flow into and out of developer housing 44, there cannot be many particles escaping from the chamber of developer housing 44. Hence, contamination from the particles contained within the developer housing is greatly reduced.

While the present invention has been described as being used in a development system, one skilled in the art will appreciate that it is not necessarily so limited and may, for example, be used in a magnetic brush cleaning system as well. Moreover, the dirt barrier of the present invention may not only be utilized in electrophotographic printing machines, but may also be used in many other machines wherein contamination from freely floating particles escaping from a housing is a problem.

In recapitulation, the apparatus of the present invention reduces or eliminates air flow into and out of a housing so as to prevent the escape of particles therefrom. In the preferred embodiment, this is achieved by a plate extending substantially parallel to and spaced from a photoconductive member. The length of this space is maintained much greater than the width so as to improve impedance to air flowing into and out of the housing. Since air flow into and out of the housing is minimized, particles remain within the housing rather than escaping therefrom.

It is, therefore, apparent that there has been provided, in accordance with the present invention, a dirt barrier which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the claims.

What is claimed is:

1. An apparatus for preventing particle contamination, including a moving member;

a housing defining a chamber for storing the particles; and means, operatively associated with said housing, for defining a surface area extending in a direction substantially parallel to and spaced from said member with the length of the surface area parallel to said member being much greater than the space between the surface area of said defining means and said member so as to minimize air flow into and out of the chamber in said housing, thereby preventing the escape of particles from the chamber of said housing.

2. An apparatus according to claim 1, wherein the ratio of the length of the surface area of said defining means to the space between the surface area of said defining means and said member ranges from about 10 to about 35.

3. An apparatus according to claim 2, wherein the length of the surface area of said defining means is preferably about 60 millimeters.

4. An apparatus according to claim 3, wherein the space between the surface area of said defining means and said moving means is preferably about 2 millimeters.

5. An apparatus according to claims 1 and 4, wherein said defining means includes a plate secured to said housing and arranged to extend in a direction outwardly from the chamber of said housing substantially parallel to and spaced from said member.

6. An electrophotographic printing machine of the type having marking particles deposited on a moving photoconductive member in image configuration, wherein the improvement includes:

a housing defining a chamber for storing at least the marking particles therein; and means, operatively associated with said housing, for defining a surface area extending in the direction substantially parallel to and spaced from the photoconductive member with the length of the surface parallel to the photoconductive member being much greater than the space between the surface area of said defining means and the photoconductive member so as to minimize air flow into and out of the chamber in said housing, thereby preventing the escape of marking particles from the chamber of said housing.

7. A printing machine according to claim 6, wherein the ratio of the length of the surface area of said defining means to the space between the surface area of said defining means and the photoconductive member ranges from about 10 to about 35.

8. A printing machine according to claim 7, wherein the length of the surface area of said defining means is preferably about 60 millimeters.

9. A printing machine according to claim 8, wherein the space between the surface area of said defining means and the photoconductive member is preferably about 2 millimeters.

10. A printing machine according to claims 6 and 9, wherein said defining means includes a plate secured to said housing and arranging to extend in a direction outwardly from the chamber of said housing substantially parallel to and spaced from the photoconductive member.

* * * * *